US007267562B2

(12) United States Patent
Katsuma

(10) Patent No.: US 7,267,562 B2
(45) Date of Patent: Sep. 11, 2007

(54) CONNECTOR

(75) Inventor: Takatoshi Katsuma, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 4 days.

(21) Appl. No.: 11/372,713

(22) Filed: Mar. 10, 2006

(65) Prior Publication Data

US 2006/0205264 A1 Sep. 14, 2006

(30) Foreign Application Priority Data

Mar. 14, 2005 (JP) ..... 2005-071260

(51) Int. Cl.
*H01R 13/44* (2006.01)

(52) U.S. Cl. ..... 439/140

(58) Field of Classification Search ..... 439/140, 439/141, 375, 892
See application file for complete search history.

(56) References Cited

U.S. PATENT DOCUMENTS 5,078,626 A * 1/1992 Matsuoka et al. ..... 439/892
5,389,007 A * 2/1995 Reinelt ..... 439/357
5,558,526 A * 9/1996 Nagamine ..... 439/140
6,305,990 B1 * 10/2001 Ward ..... 439/752
6,761,568 B2 * 7/2004 Bakker et al. ..... 439/140
6,866,552 B2 * 3/2005 Koehler ..... 439/892
2002/0168895 A1 11/2002 Suzuki

* cited by examiner

*Primary Examiner*—Neil Abrams
*Assistant Examiner*—PhuongChi Nguyen
(74) *Attorney, Agent, or Firm*—Gerald E. Hespos; Anthony J. Casella

(57) ABSTRACT

A retainer (20) and a moving plate (10) are inserted into a hood (12) of a connector (F). A locking piece (22) projects from a front surface of the retainer (20). A locking hole (41) is formed through the moving plate (10). The locking piece (22) penetrates through the locking hole (41) to lock a locking projection (27) at a front end of the locking piece (22) to a periphery of the locking hole (41). Thus, the moving plate (10) is supported and is prevented from moving longitudinally. A thick reinforcement (44) is formed on the periphery of the locking hole (41) of the moving plate (10) to fill a gap between the moving plate (10) and the locking projection (27).

16 Claims, 8 Drawing Sheets

CONNECTOR

BACKGROUND OF THE INVENTION

1. Field of the Invention

The invention relates to a connector that has a moving plate.

2. Description of the Related Art

Published U.S. Pat. Appl. Publication No. US 2002/0168895 A1 discloses a connector with a hood that has a closed rear end and an open front end. The connector also has a moving plate formed with a plurality of guide holes. The moving plate is accommodated movably in the hood and is connected with a guide by two cantilevered booms. The moving plate is thinned to reduce weight.

Flexible locking pieces are provided for holding the moving plate in the hood. Each locking piece has a locking projection for engaging a mating lock. The locking projections rotate through circular arcs as the locking pieces deform elastically. Thus, a gap is formed between the locking surface of the locking projection and the opposed surface of the mating lock due to the locus of rotation of the locking projection. The gap reduces the engaged surface areas between the locking projection and the mating lock, and hence the moving plate is not held securely.

The moving plate could collide with another component and such a collision could deform the thin moving plate. As a result, there is a fear that the deformed moving plate could become unlocked from the locking projection and could move inadvertently.

The invention has been completed in view of the above-described situation. Therefore it is an object of the invention to provide a connector in which a moving plate is prevented from being unlocked inadvertently from a locking piece.

SUMMARY OF THE INVENTION

The invention relates to a connector assembly that includes a male connector and a female connector. The male connector has a male housing with opposite front and front and rear ends. Male terminal fittings are accommodated in the male housing and have tabs that project towards the front end. A forwardly open hood projects forward on the male housing and surrounds the tabs of male terminal fittings. The female connector has a female housing that can be fit in the hood of the male housing. Flexibly deformable locking pieces are accommodated in the hood and project forward towards the open front end. A locking projection is formed at the front end of each locking piece. A plate-shaped moving plate is accommodated in the hood and extends substantially orthogonal to a mating direction of the female and male connectors. The moving plate includes positioning holes for receiving the tabs and locking holes for receiving the locking pieces. A thick reinforcement is formed along the periphery of each locking hole of the moving plate to fill a gap between the moving plate and each of the locking projections. The locking projection of each locking piece is locked to the periphery of the respective locking hole to prevent a movement of the moving plate. However, this locked state is released, when the female connector is fit in the male connector. Thus, the moving plate can be moved rearward and the tabs project from the respective positioning holes. The thick reinforcement along the periphery of each locking hole of the moving plate fills the gap between the moving plate and the projection and prevents the moving plate from being unlocked inadvertently from the locking state.

The locking projection preferably includes front and rear projections. The front projection is forward of the moving plate and the rear projection is rearward of the moving plate when the moving plate is locked to the locking projection. A rear surface of the front projection is sloped and becomes distant from a front surface of the moving plate as the rear surface of the front projection approaches a projected end thereof. The reinforcement is formed on the front surface of the moving plate and confronts the slope of the front projection and a front surface of the rear projection so that the moving plate is sandwiched between the front and rear projections. Thus, the moving plate is locked firmly locked between the front projection forward of the moving plate and the rear projection rearward of the moving plate. Further the reinforcement between the locking projection and the moving plate prevents the moving plate from being unlocked inadvertently from the locking piece.

The moving plate preferably does not contact an inner surface of the hood. Thus, there is no friction between the moving plate and the inner surface of the hood during movement of the moving plate and a force required to move the moving plate is reduced.

A plate-shaped retainer preferably is disposed at a rear side of the hood and is substantially parallel with the moving plate. A proximal portion of the locking piece preferably is connected with a front surface of the retainer. If the proximal portion of the locking piece was connected directly with the rear surface of the hood, it would be necessary to provide the retainer with a hole through for the locking piece penetrates. However, the proximal portion of the locking piece is connected with the front surface of the retainer. Therefore, it is unnecessary to form a hole through the retainer.

DETAILED DESCRIPTION OF THE PREFERRED EMBODIMENTS

A connector assembly in accordance with the invention is illustrated in FIGS. 1 through 8, and includes a female connector F that can be fit in a male connector M. The male connector M has a moving plate 10 and a retainer 20. In the description made below, the fit-in ends of the female connector F and the male connector M are referred to as the front.

Figure 6:
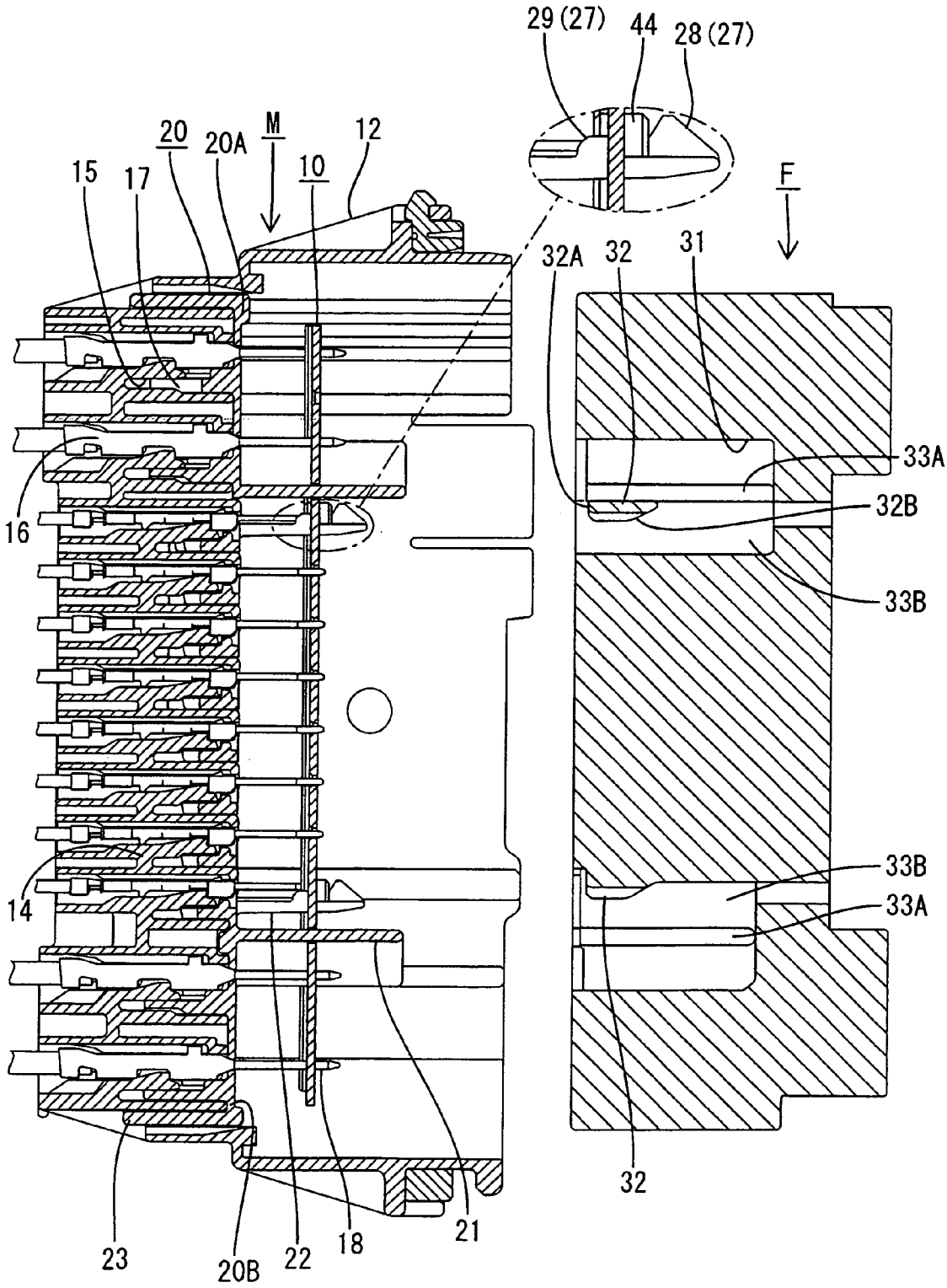
FIG. 6 is a sectional view showing a state in which the retainer is mainly locked at a main locking position.

The female connector F has a female housing for accommodating a plurality of female terminal fittings (not shown) therein. As shown in FIG. 6, the female housing is made of a synthetic resin and is long in a height direction, which is the direction in which female terminal fittings are arranged. Upper and lower concave portions 31 are formed at the top and bottom of the female connector F and open at the front end of the female connector F. The upper and lower concave portions 31 extend in a longitudinal direction of the female connector F and have a depth dimension set to receive a portion of the retainer 20 of the male connector M when the female connector F is fit in the male connector M, as explained herein. Unlocking portions 32 are formed inside the concave portions 31. The unlocking portion 32 is at a front end of the upper concave portion 31 and in a central position thereof along the height direction. A groove 33A is provided in the upper concave portion 31 above the unlocking portion 32 and a groove 33B is provided in a portion of the upper concave portion 31 below the unlocking portion 32. The grooves 33A, 33B communicate with each other in a region rearward of the unlocking portion 32.

The unlocking portion 32 of the lower concave portion 31 is formed at a front side of an upper surface of the lower concave portion 31. A groove 33B is provided in an upper portion of the lower concave portion 31, whereas a groove portion 33A is provided in a lower portion of the lower concave portion 31. The grooves 33A and 33B of the lower concave portion 31 communicate with each other over their entire lengths. A front surface 32A of each unlocking portion 32 is erect substantially vertically so that the front surface 32A of the unlocking portion 32 interferes with the locking piece 22 and serves as an unlocking surface for flexing the locking piece 22 in an unlocking direction. A rear surface 32B of the unlocking portion 32 slopes up and to the rear.

The male connector M has a terminal accommodation part 11 made of synthetic resin and a hood 12 also made of synthetic resin. The male connector M is extended long in its height direction in correspondence to the female connector F.

Figure 5:
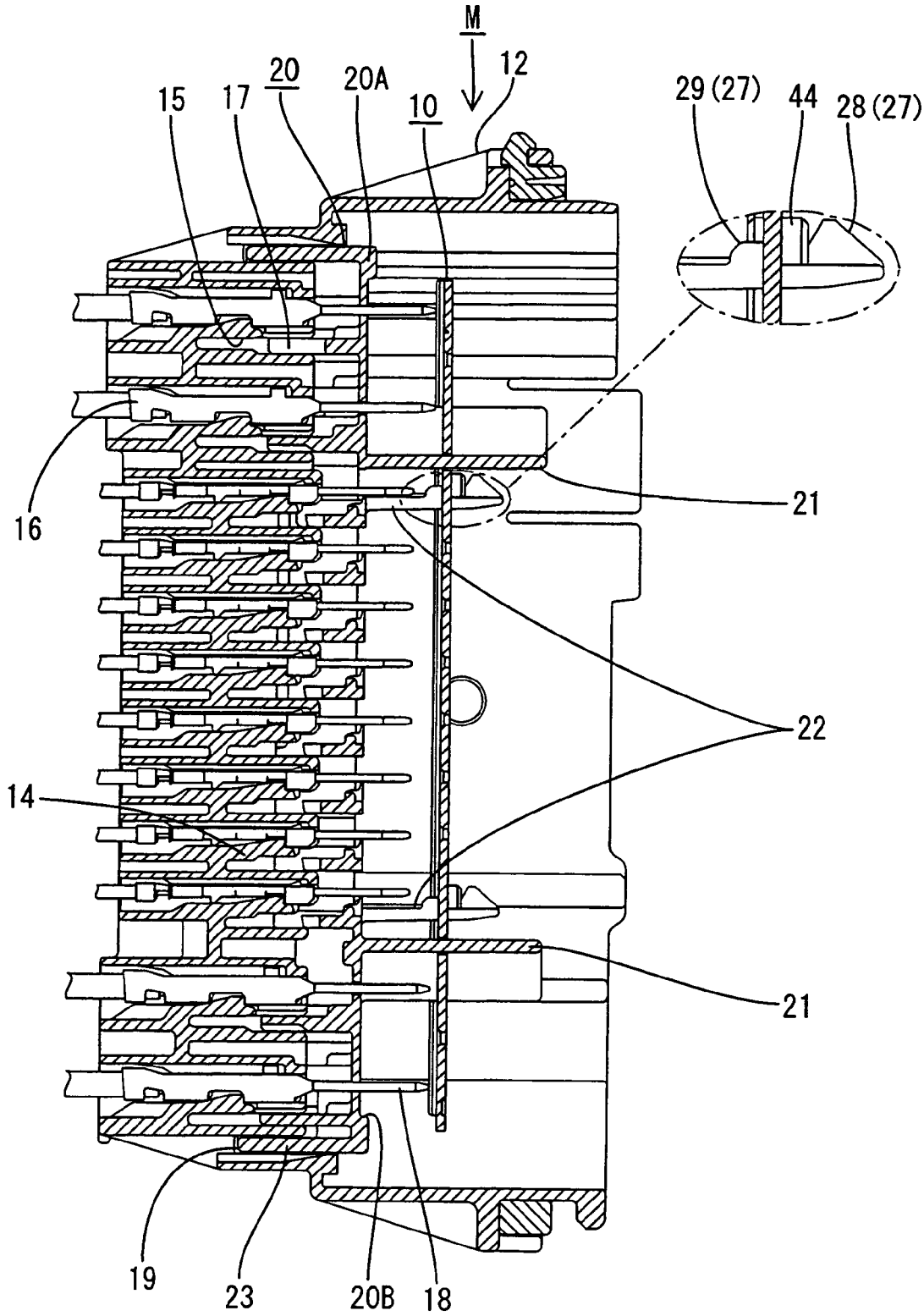
FIG. 5 is a sectional view showing a state in which a retainer is temporarily locked at a temporary locking position.

Cavities 13 are arranged in the height direction in the terminal accommodation part 11 and a flexibly deformable lance 14 is cantilevered forward on a lower surface of each cavity 13. A forwardly open flexing space 15 is disposed below the lance 14 to accommodate flexing of the lance 14. Male terminal fittings 16 can be inserted into the respective cavities 13 from the rear of the terminal accommodation part 11. However, the lance 14 interferes with the corresponding male terminal fitting 16. Thus the male terminal fitting 16 causes the lance 14 to deform flexibly into the flexing space 15. The lance 14 returns to its original state and locks the respective male terminal fitting 16 when the male terminal fitting 16 reaches a predetermined normal connection position. Guide holes 19 are formed at the top and bottom ends of the terminal accommodation part 11 and open in the front and rear ends, as shown in FIG. 5.

The hood 12 projects forward from a front surface of the terminal accommodation part 11 and has the shape of a generally rectangular tube. Each male terminal fitting 16 has a tab 18 that projects into the hood 12, as shown in FIG. 5. The retainer 20 and the moving plate 10 are accommodated in the hood 12 at positions where the retainer 20 and the moving plate 10 are out of contact with an inner side surface 12A of the hood 12.

The retainer 20 is formed unitarily of a synthetic resin and is a front-type retainer. That is, the retainer 20 has a plate-shaped body 20A configured to cover the front surface of the terminal accommodation part 11. The body 20A of the retainer 20 has a plurality of tab insertion holes 24 at positions corresponding to the positions of the cavities 13 of the terminal accommodation part 11. Rearwardly projecting guides 23 are formed at the top and bottom ends of the body 20A. The guides 23 are disposed and dimensioned to fit in the guide holes 19 of the terminal accommodation part 11. Flexing prevention portions 17 project rearward on the rear surface of the body 20A substantially at the peripheries 25 of the tab insertion holes 24. The flexing prevention portions 17 are disposed and dimensioned to enter the flexing spaces 15 for the respective lance 14.

The retainer 20 is movable between a temporary locking position and a main locking position relative to the male connector M. The flex preventing portions 17 are at front ends of the flexing spaces 15 when the retainer 20 is at the temporary locking position, thereby allowing the lances 14 to deflect and permitting the male terminal fittings 16 to be inserted into and removed from the cavities 13. The flexing prevention portions 17 penetrate into the flexing spaces 15 for the lances 14 when the retainer is at the main locking position, thereby preventing the lances 14 from flexing and preventing the male terminal fitting 16 from being removed from the cavity 13. More specifically, the guides 23 penetrate partly into the guide holes 19 when the retainer 20 is at the temporary locking position, and the body 20A of the retainer 20 is spaced forward from the front surface of the terminal accommodation part 11. On the other hand, the guides 23 advance deep into the guide hole 19 and the body 20A of the retainer 20 closely contacts the front surface of the terminal accommodation part 11 when the retainer 20 has reached the main locking position. The guides 23 slide in contact with the guide holes 19 as the retainer 20 moves from the temporary locking position to the main locking position. Thus, a stable insertion of the retainer 20 is ensured.

Bending prevention portions 21 project forward from upper and lower parts of the front surface of the body 20A of the retainer 20 at positions for alignment with the concave portions 31 of the female connector F. Locking pieces 22 also project from the front surface of the body 20A of the retainer 20. The locking pieces 22 are between the bending preventing portions 21 and extend substantially parallel to and adjacent the bending prevention portions 21. The front end of each bending prevention portion 21 is forward from the front ends of the tabs 18 and the front ends of the locking pieces 22. The bending prevention portions 21 function like eaves and protectingly cover the locking piece 22. Thus, the locking piece 22 will not be broken or deformed unintentionally by interference with a component disposed near the locking piece 22. The bending prevention portions 21 can penetrate into the concave portions 31 of the female connector F when the female connector F takes a normal posture, thus allowing the female connector F to be fit in the male connector M normally. On the other hand, the bending prevention portion 21 prevents the female connector F from fitting in the male connector M when the female connector F is not in the normal posture, and thus prevents a collision between the tab 18 and the female connector F so that the tab 18 does not twist or bend.

Figure 2:
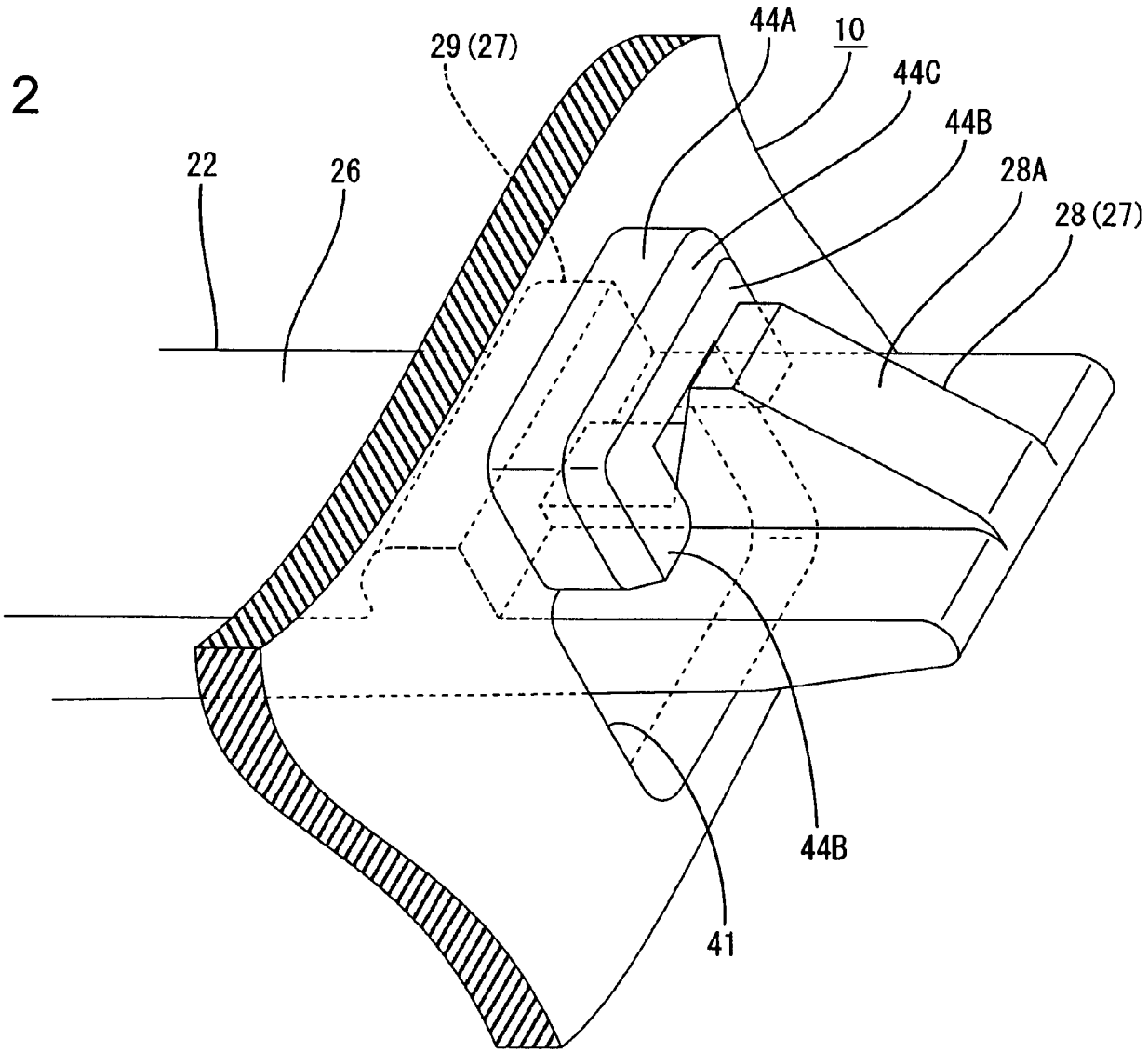
FIG. 2 is a main part-enlarged perspective view showing a state in which a moving plate is locked by a locking projection.
Figure 3:
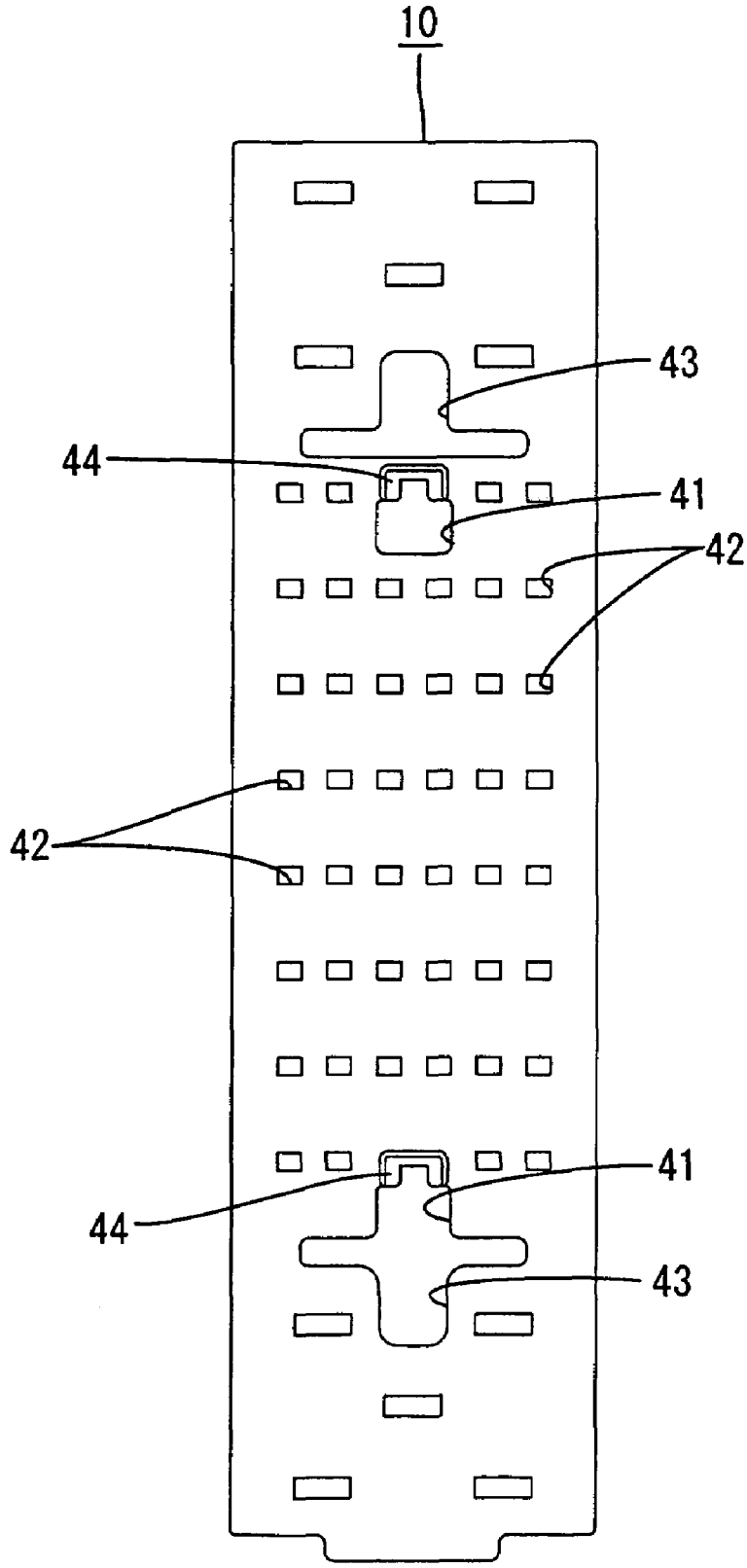
FIG. 3 is a front view showing the moving plate.

The locking piece 22 has a flexibly deformable arm 26 that is cantilevered forward from the front surface of the retainer 20. A lock 27 is formed at a front end of the arm 26. More specifically, as shown in FIG. 2, the lock 27 includes a front projection 28 and a rear projection 29. The rear projection 29 is formed on an upper surface of the arm 26 and extends over the entire width of the arm 26. A front surface 29A of the rear projection 29 is substantially normal to the extending direction of the arm 26. A rear surface 29B of the rear projection 29 is a substantially circular arc curved up towards the upper surface of the rear projection 29. The front projection 28 projects from approximately a widthwise central position of the upper surface of the arm 26 and the front-end of the front projection 28 is coincident with a front end of the arm 26. The front projection 28 has a tapered front surface 28A that slopes up and to the rear and a tapered rear surface 28B that slopes down and to the rear. The rear surface 28B of the front projection 28 tapers because the front projection 28 moves through a circular arc while the locking piece 22 is flexibly deforming. The front projection 28 and the rear projection 29 are connected with each other by a rib 29C (see FIG. 8). The rib 29C has a width substantially equal to the width of the front projection 28. Right and left side surfaces of the rib 29C are continuous and flush with the right and left side surfaces of the front projection 28.

Figure 1:
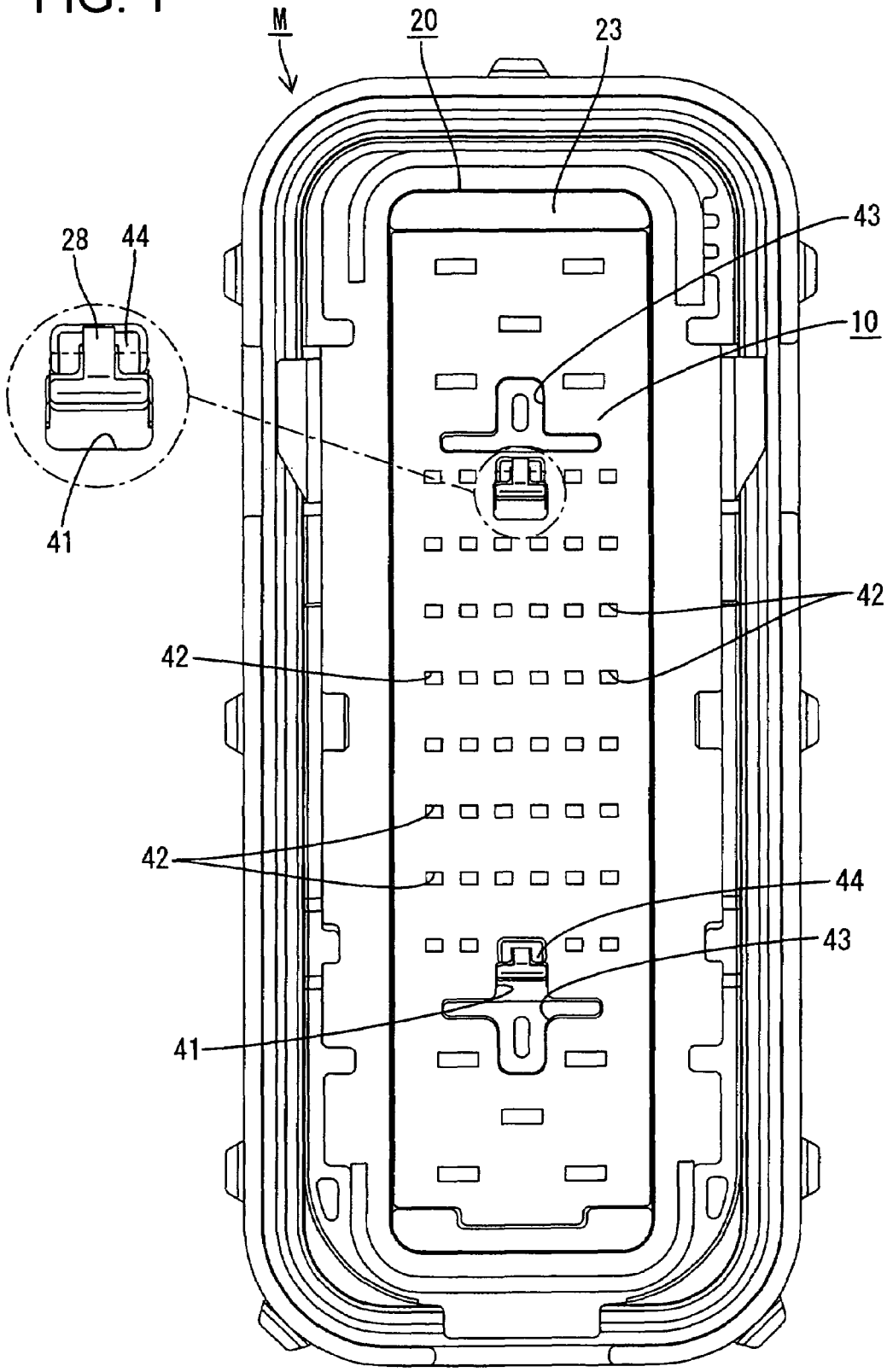
FIG. 1 is a front view showing a male connector of one embodiment of the present invention.
Figure 4:
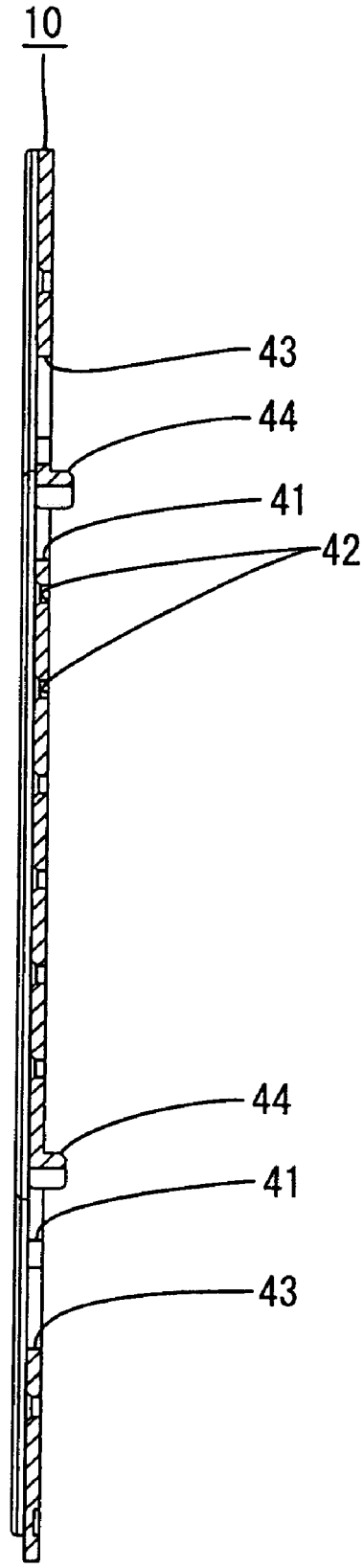
FIG. 4 is a sectional view showing the moving plate.

The moving plate 10, as shown in FIG. 4, is made of a synthetic resin and is thin. The moving plate 10 has locking holes 41 at positions corresponding to the positions of the locking pieces 22 of the retainer 20. The moving plate 10 also has positioning holes 42 at positions corresponding to the positions of the tabs 18 of the male terminal fittings 16 and insertion holes 43 at positions corresponding to the positions of the bending prevention portions 21 of the retainer 20. As shown in FIG. 2, a thick reinforcement 44 is formed integrally with the front surface of the moving plate 10 along the periphery of each locking hole 41. The reinforcement 44 includes a crosslinking portion 44A and two legs 44B connected with right and left ends of the crosslinking portion 44A. Thus the reinforcement 44 is gate-shaped. An upper edge 44C of the front surface of the reinforcement 44 is entirely chamfered The retainer 20 and the moving plate 40 can be assembled together. More particularly, the bending prevention portions 21 can pass through the insertion holes 43. As shown in FIG. 1, the insertion holes 43 of the moving plate 10 have an inverted T-shape (i.e. ⊔) corresponding to the inverted T-shape sectional configuration of the bending prevention portion 21. A partitioning wall is between the upper locking piece 22 and the insertion hole 43. However, the lower locking piece 22 communicates with the insertion hole 43 and is open in the shape of a plus sign (i.e. +). The flexibly deformable locking pieces 22 also can pass through the respective locking holes 41. More specifically, as shown in FIG. 2, the front projection 28 of each lock 27 is disposed forward from the moving plate 10 and the rear projection 29 of each lock 27 is disposed rearward from the moving plate 10. Thus the moving plate 10 is sandwiched between the rear projection 29 and the front projection 28 in the thickness direction so that the moving plate 10 is locked to the lock 27. That is, the front projected portion 28 prevents the moving plate 10 from moving forward, whereas the rear projected portion 29 prevents the moving plate 10 from moving rearward.

The retainer 20 and the moving plate 10 can be mounted in the hood 12 of the male connector M. As shown in FIG. 5, the locking piece 22 of the retainer 20 supports the moving plate 10 in a position spaced from the inner surface of the hood 12. The moving plate 10 is forward from the front end of the tab 18 when the retainer 20 is at the temporary locking position in the male connector M. The moving plate 10 moves together with the retainer 20 as the retainer 20 moves towards the main locking position. The front end of the tab 18 has moved through the positioning hole 42 and is at the front surface of the retainer 20 when the retainer 20 is at the main locking position. The unlocking portion 32 of the female connector F engages the lock 27 when the female connector F is being fit in the hood 12. Thus, the unlocking portion 32 deforms the locking piece 22 flexibly, and the moving plate 10 is unlocked from the locking piece 22. The front surface of the female connector F then moves towards the moving plate 10 and eventually moves the moving plate 10 rearward into contact with the front surface of the retainer 20. Accordingly, the moving plate 10 is pressed against the front surface of the terminal accommodation part 11 through the retainer 20. The tabs 18 project gradually from the positioning holes 42 of the moving plate 10 as the moving plate 10 is moved rearward. The tabs 18 then connect electrically with the female terminal fittings of the female connector F. Accordingly, the moving plate 10 has a role of placing the tab 18 of the male terminal fitting 16 in position and guiding both female and male terminal fittings to their normal connection positions.

Figure 8:
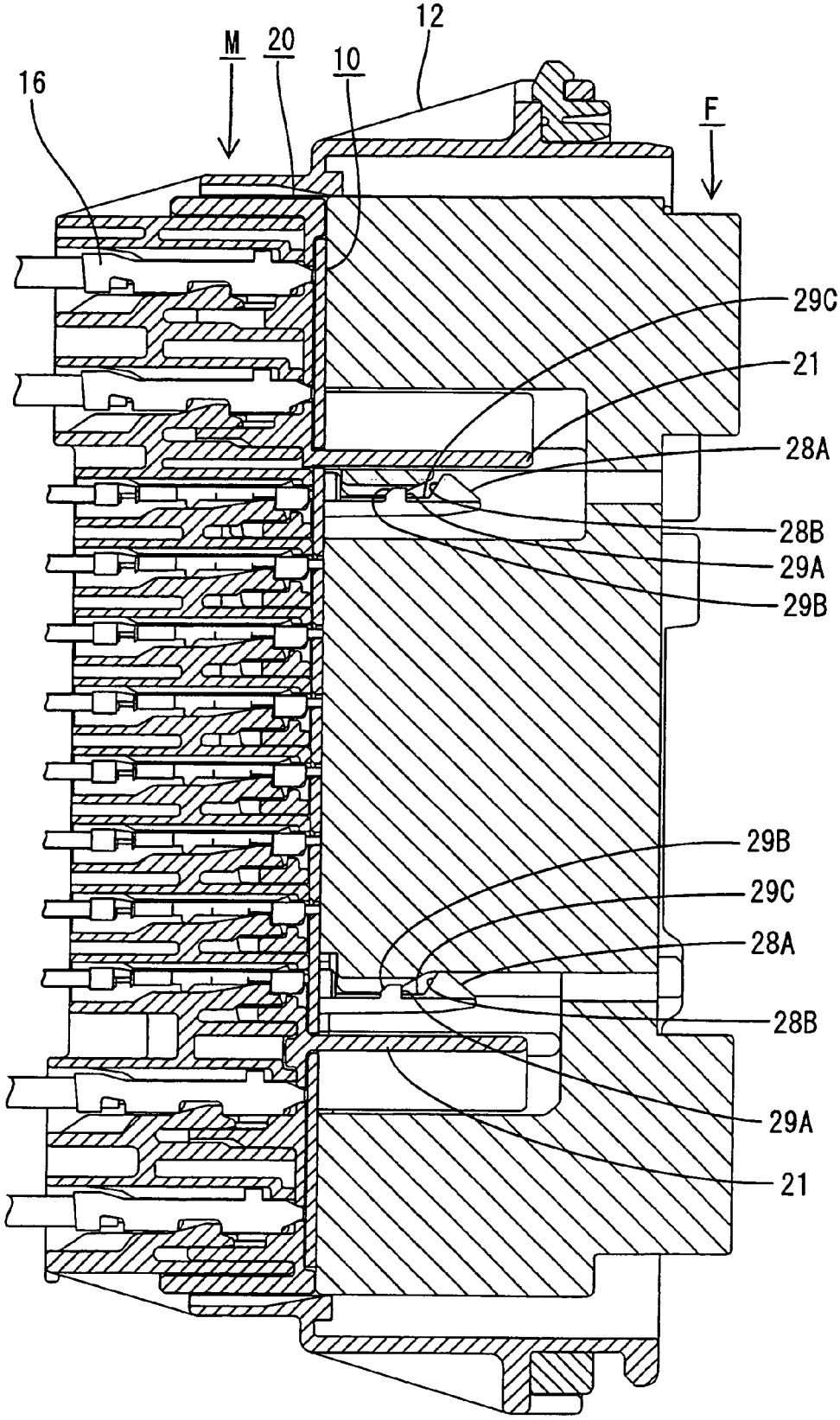
FIG. 8 is a sectional view showing a state in which the female connector has been normally fitted in the male connector.

The moving plate 10 fits tightly in an inner side of a stepped surface 20B formed at both ends of the front surface of the retainer 20 in the height direction. Thus, the front surfaces of the moving plate 10 and the retainer 20 become continuous and flush with each other, as shown in FIG. 8.

As shown in FIG. 2, the reinforcement 44 on the front surface of the moving plate 10 and along the periphery of each locking hole 41 fills the gap between the moving plate 10 and the front projection 28. More particularly, the crosslinking portion 44A of the reinforcement 44 crosses the tapered rear surface 28B of the front projection 28 in the width direction and contacts the tapered rear surface 28B when the locking projection 27 is locked to the periphery of the locking hole 41. The legs 44B and the crosslinking portion 44A straddle the tapered rear surface 28B of the front projection 28, with the rib 29C of the locking projection 27 disposed in a space formed by the legs 44B and the crosslinking portion 44A. Therefore the crosslinking portion 44A confronts the upper half of the front projection 28, whereas right and left legs 44B confront right and left sides of the rear projection 29, with the moving plate 10 sandwiched between the front projection 28 and the rear projection 29.

The moving plate 10 initially is disposed in front of the retainer 20 and is supported by the locking piece 22. At this time, the tapered front surface 28A of the front projection 28 slides along the periphery of the locking hole 41 of the moving plate 10. As a result, the locking piece 22 deforms down flexibly. The locking piece 22 returns to its original state when the front projection 28 passes through the locking hole 41. Thus, the moving plate 10 is sandwiched between the front and rear projections 28 and 29 and cannot move longitudinally.

The retainer 20 then is moved into the temporary lock position in the hood 12 so that the guides 23 enter the guide holes 19, as shown in FIG. 5. The male terminal fittings 16 then are inserted into the respective cavities 13 of the terminal accommodation part 11 from the rear and are locked primarily to the respective lances 14. As a result, the tab 18 of each male terminal fitting 16 penetrates through the corresponding tab insertion hole 24 of the retainer 20, and the front end of each tab 18 is disposed in front of the corresponding positioning hole 42 of the moving plate 10. Thereafter, as shown in FIG. 6, the retainer 20 is pressed into the main locking position, and the flexing prevention portion 17 of the retainer 20 penetrates into the flexing space 15 for the lance 14 to secondarily lock the male terminal fitting 16 to the retainer 20. In this manner, the male terminal fitting 16 is locked unremovably to the lance 14 and the retainer 20. The front ends of the tabs 18 penetrate into the positioning holes 42 of the moving plate 10 respectively when the retainer 20 reaches the main locking position so that the tabs 18 are in proper positions.

Figure 7:
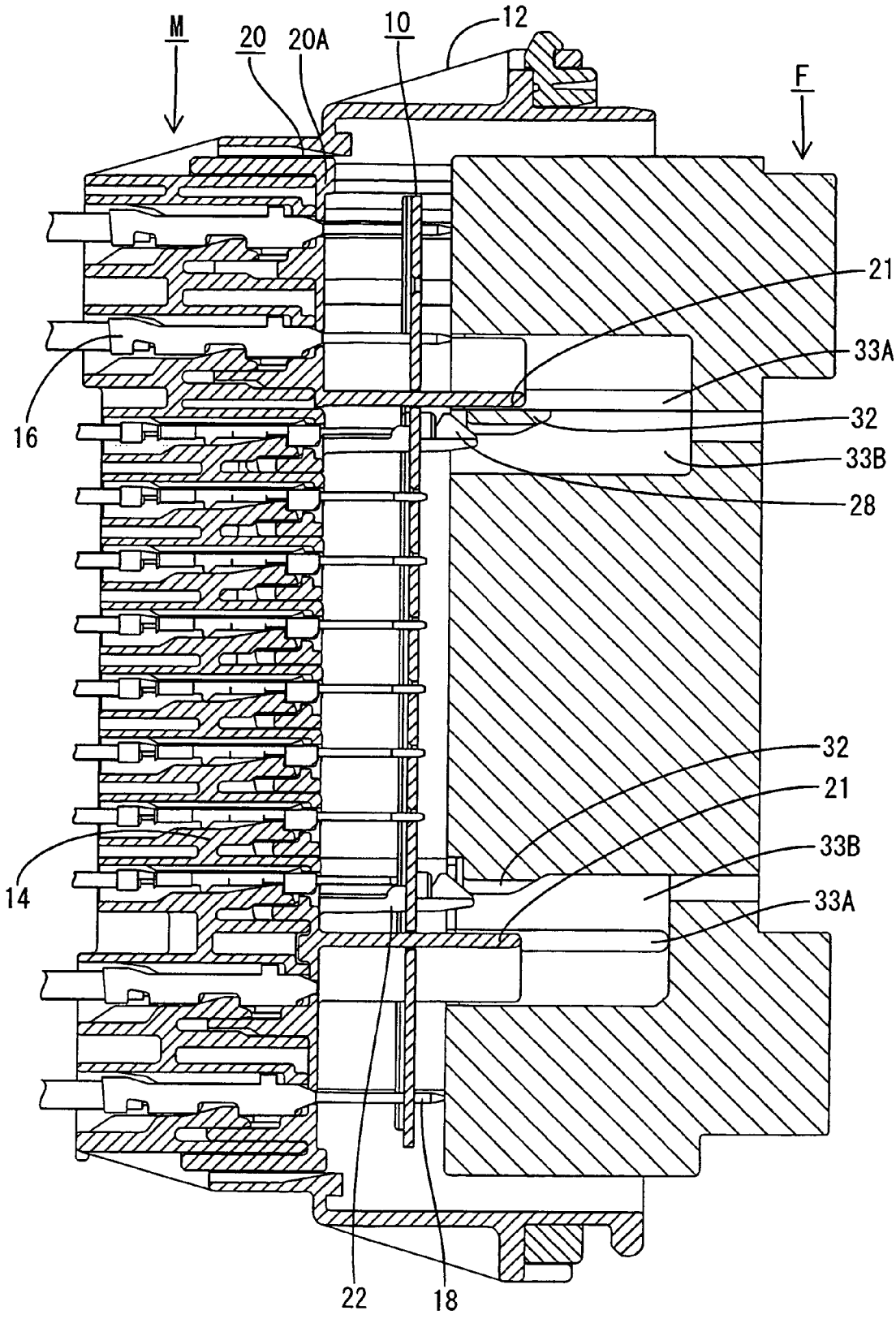
FIG. 7 is a sectional view showing a state in which an operation of fitting a female connector in a male connector has started.

The female connector F then is penetrated into the hood 12. The unlocking portion 32 of the female connector F contacts the front projection 28 when the female connector F advances approximately to the center of the hood 12, as shown in FIG. 7. The locking pieces 22 deform flexibly down as the female connector F advances deeper into the hood 12. As a result, the moving plate 10 is unlocked from the locks 27 of the retainer 20. The moving plate 10 is guided by the bending prevention portion 21 and moves towards the rear side of the hood 12 as the female connector F is pressed more deeply into the hood 12. During this time, the moving plate 10 is out of contact with the inner surface of the hood 12. The moving plate 10 and the retainer 20 are pressed against the front surface of the terminal accommodation part 11 when the female connector F is fit completely into the male connector M, as shown in FIG. 8, and the female and male terminal fittings are connected with each other in a normal depth.

An external force could act on the moving plate 10 from the front before the female connector F enters the hood 12. Accordingly, there is a fear that the thin moving plate 10 will deform and disengage from the locking projection 27. However, the thick reinforcement 44 is formed on the periphery of the locking hole 41 of the moving plate 10 to fill the gap between the locking projection 27 and the moving plate 10. Thus, the moving plate 10 is not likely to be unlocked inadvertently from the locking projection 27. Further, the moving plate 10 does not contact the inner surface 12A of the hood 12, and hence there is no friction between the moving plate 10 and the inner surface 12A of the hood 12 during movement of the moving plate 10. Thus it is possible to reduce a pressing force.

Furthermore, the proximal portion of the locking piece 22 connects with the front surface of the retainer 20. Thus molding can be performed easily.

The invention is not limited to the above-described embodiment described above with reference to the drawings. For example, the following embodiments are included in the technical scope of the present invention. Further, various modifications of the above-described embodiment can be made without departing from the spirit and scope of the present invention.

In the above-described embodiment, the moving plate is disposed out of contact with the inner side surface of the hood part. However, the moving plate may be disposed in contact with the inner side surface of the hood part.

In the above-described embodiment, the locking projection has front and rear projections. However, the locking projection may have only the front projection.

In the above-described embodiment, two legs are disposed in confrontation with both widthwise ends of the rear projection, and the moving plate is sandwiched between the front and rear projections of the moving plate in the thickness direction of the moving plate. Considering that it is necessary to fill the gap between the front projection and the moving plate in the present invention, the reinforcing portion does not necessarily have to include the two legs.

What is claimed is:

1. A connector comprising:

a terminal accommodating part;

male terminal fittings mounted in the terminal accommodating part and having tabs projecting forward from the terminal accommodating part;

a hood projecting forward from the terminal accommodating part and surrounding the tabs of the male terminal fittings, the hood being configured for receiving a female connector;

flexibly deformable locking pieces projecting forward in the hood, a lock being formed at a front end of each of said locking pieces; and a moving plate movably disposed in the hood, said moving plate having positioning holes for receiving said tabs and locking holes for receiving said locking pieces so that said locks retain the moving plate, a reinforcement being formed at a periphery of each of said locking holes of said moving plate to fill a gap between said moving plate and each of said locks, whereby movement of said female connector into said hood deforms said locking pieces sufficiently to release said locks from said moving plate so that said moving plate can be moved rearwardly in the hood and so that said tabs be projected from said positioning holes.

2. The connector of claim 1, wherein said moving plate is spaced from an inner surface of said hood.

3. The connector of claim 1, further comprising a plate-shaped retainer disposed at a rear side of said hood and being aligned substantially parallel with said moving plate.

4. The connector of claim 3, wherein said locking piece projects from a front surface of said retainer.

5. The connector of claim 1, wherein each of said locks comprises a front projection disposed forward from said moving plate and a rear projection disposed rearward from said moving plate when said moving plate is locked to said lock.

6. The connector of claim 5, wherein said front projection has a sloped rear surface aligned to become increasingly distant from a front surface of said moving plate as said sloped rear surface of said front projection approaches a projected end thereof.

7. The connector of claim 6, wherein said reinforcement is formed on a front surface of said moving plate and in confrontation with said sloped rear surface of said front projection.

8. The connector of claim 7, wherein the moving plate is sandwiched between said sloped rear surface of the front projection and a front surface of said rear projection.

9. A connector comprising:

a terminal accommodating part having opposite front and rear ends, cavities extending through the terminal accommodating part and lances projecting respectively into the cavities;

male terminal fittings mounted respectively in the cavities and locked respectively by the lances, the terminal fittings having tabs projecting forward from the terminal accommodating part;

a hood projecting forward from the terminal accommodating part and surrounding the tabs of the male terminal fittings;

a retainer mounted in the hood for movement between a partial locking position and a full locking position, the retainer having a plate-shaped body, tab insertion holes formed through the body for receiving the tabs, flex preventing portions projecting rearward from the body and engaging the lances when the retainer is in the full locking position, locking pieces projecting forward on the retainer, a lock being formed at a front end of each of said locking pieces; and a moving plate movably disposed in the hood, said moving plate having positioning holes for receiving said tabs and locking holes for receiving said locking pieces so that said locks releasably retain the moving plate in spaced relationship to the body, whereby movement of a female connector into said hood deforms said locking pieces sufficiently to release said locks from said moving plate so that said moving plate can be moved rearwardly in the hood and towards the body and so that said tabs be projected from said positioning holes.

10. The connector of claim 9, wherein said moving plate is spaced from an inner surface of said hood.

11. The connector of claim 9, wherein each of said locks comprises a front projection disposed forward from said moving plate and a rear projection disposed rearward from said moving plate when said moving plate is locked to said lock.

12. The connector of claim 11, wherein said front projection has a sloped rear surface aligned to become increasingly distant from a front surface of said moving plate as said sloped rear surface of said front projection approaches a projected end thereof.

13. The connector of claim 12, wherein the moving plate has a rear surface facing the retainer and an opposite front surface, reinforcements being formed on said front surface of said moving plate substantially adjacent the locking holes and in confrontation with said sloped rear surface of said front projection.

14. The connector of claim 9, further comprising bending preventing portions projecting forward from the body of the retainer substantially adjacent the locking pieces.

15. The connector of claim 14, wherein the locking pieces are between the bending preventing portions.

16. The connector of claim 15, wherein the bending preventing portions project farther than the locking pieces.

* * * * *